United States Patent [19]

Kurtz

[11] Patent Number: 5,058,509

[45] Date of Patent: Oct. 22, 1991

[54] RAILWAY CAR WITH VENTED BOLSTER TO FACILITATE THE THAWING OF LADING

[75] Inventor: William E. Kurtz, Johnstown, Pa.

[73] Assignee: Bethlehem Steel Corp., Bethlehem, Pa.

[21] Appl. No.: 710,874

[22] Filed: Jun. 6, 1991

Related U.S. Application Data

[63] Continuation of Ser. No. 514,810, Apr. 26, 1990, abandoned.

[51] Int. Cl.[5] ..... B61F 5/00

[52] U.S. Cl. ..... 105/226; 105/247; 105/451

[58] Field of Search ..... 105/199.1, 200, 226, 105/239, 247, 248, 451, 404

[56] References Cited

U.S. PATENT DOCUMENTS

| | | | |
|---|---|---|---|
| 2,020,391 | 11/1935 | Wine | 105/247 |
| 2,092,457 | 9/1937 | Kiesel | 105/247 |
| 2,766,705 | 10/1956 | Flowes | 105/451 |
| 3,584,564 | 6/1971 | Rollins | 105/247 X |
| 4,348,962 | 9/1982 | Smith | 105/248 |
| 4,696,238 | 9/1987 | Billingsley | 105/248 |

*Primary Examiner*—Robert J. Oberleitner
*Assistant Examiner*—S. Joseph Morano
*Attorney, Agent, or Firm*—John I. Iverson

[57] ABSTRACT

A railway car suitable for rotary or bottom dump unloading. The body bolster is fitted with vents to permit a heating of the slope floor at the ends of the car to thaw the lading prior to unloading.

4 Claims, 1 Drawing Sheet

Fig. 1
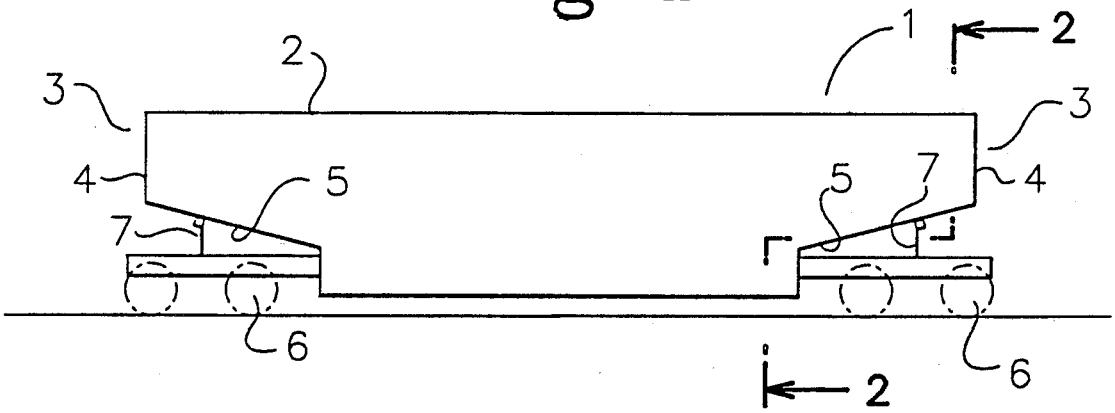
Fig. 2
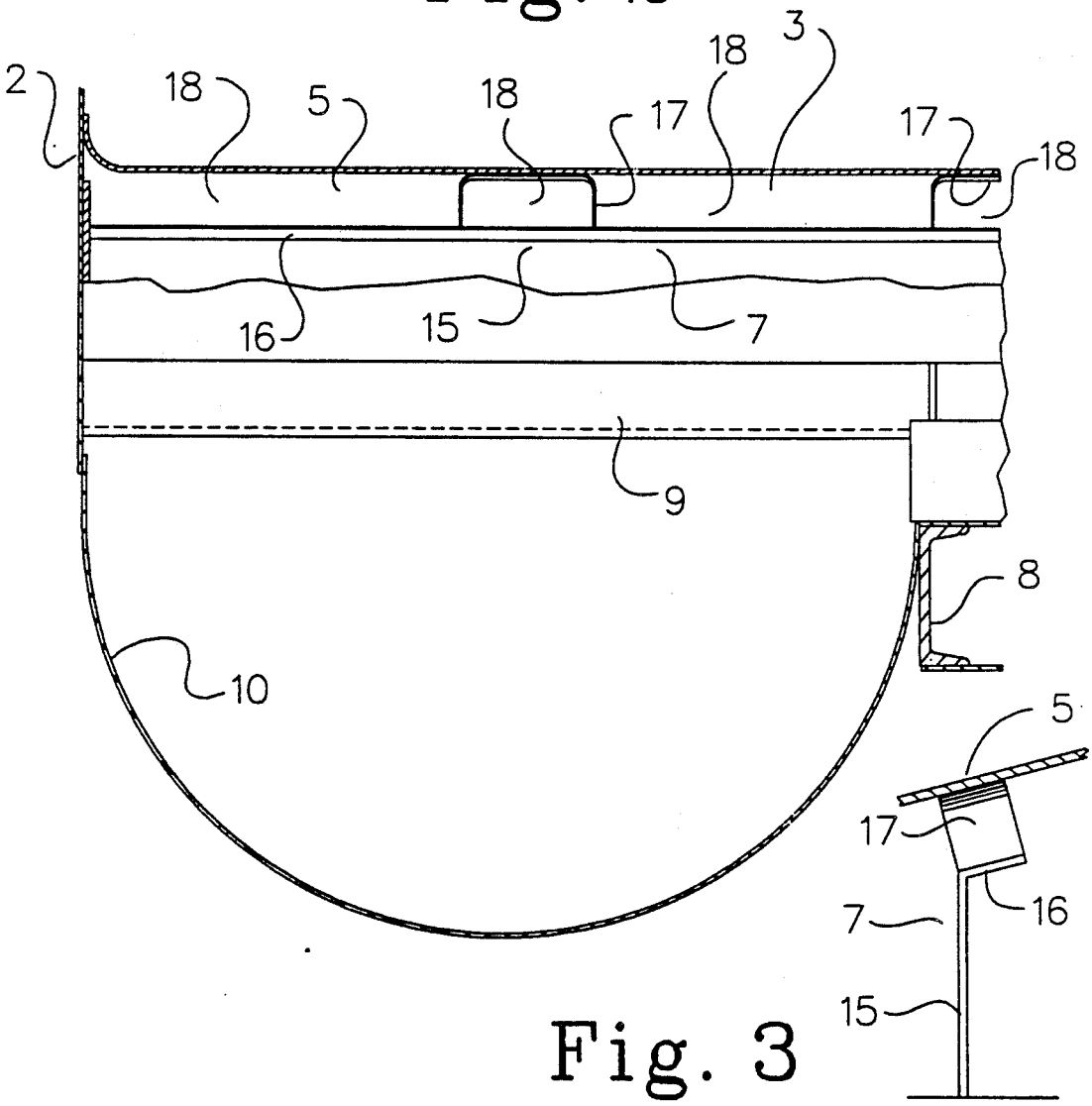
Fig. 3

RAILWAY CAR WITH VENTED BOLSTER TO FACILITATE THE THAWING OF LADING

This is a continuation of co-pending application Ser. No. 07/514,810 filed on Apr. 26, 1990 now abandoned.

BACKGROUND OF THE INVENTION

This invention relates to a railway car of the gondola or hopper types commonly used to carry bulk materials, such as coal, sand, gravel, ore and the like It relates particularly to a railway car which is loaded through its open top and unloaded through the bottom or in a rotary car dumper which inverts the entire car to unload its contents.

Many cars are currently used to transport coal to utility plants and to steel plants. If those plants are located in the northern part of the United States or Canada, the coal in such cars frequently freezes during the winter as it is being transported and makes dumping difficult. Utilities and steel plants are required to install car thawing facilities to thaw the frozen coal in the cars sufficiently to permit the coal to be dumped.

The car thawing facilities usually consist of a long shed capable of containing about a dozen cars at one time and equipped with gas burners laid alongside and between the track rails to heat the bottoms of the frozen cars for several hours.

It has been observed that when the thawed cars are dumped, frozen coal often still adheres to the car body in the area of the slope floors at the ends of the car. This requires a further thawing and delay in unloading of the car.

SUMMARY OF THE INVENTION

It is an object of this invention to provide an improved railway car which has a structure for improved thawing of frozen lading in the car.

It is a further object of this car to provide an improved railway car which has less wind resistance when traveling in a train of cars.

It has been discovered that the foregoing objectives can be attained by a railway car for carrying bulk materials having a pair of sidewalls and a pair of end walls, each of the end walls having a vertical upper portion and a sloping lower portion supported on spaced trucks by a pair of body bolsters, the bolsters having a substantially solid lower portion and a vented open upper portion adjacent to the sloping lower portion of the end walls.

BRIEF DESCRIPTION OF THE DRAWINGS

FIG. 1 is a side elevation view of a gondola car of this invention.

FIG. 2 is a section taken along line 2—2 of FIG. 1.

FIG. 3 is a side elevation view of the body bolster of this invention.

DESCRIPTION OF THE PREFERRED EMBODIMENT

The preferred embodiment of this invention is a gondola or hopper car that resembles the conventional A.A.R. Class "G" or "HT" open top rotary dump gondola or open top bottom dump hopper car. Such a gondola car is shown generally in FIG. 1 and comprises a rectangular car 1 having a pair of vertical sidewalls 2 and a pair of end walls 3. The end walls 3 have an upper vertical portion 4 and an inclined or horizontal lower portion 5 which extends over conventional car trucks 6.

A body bolster 7 connects the inclined portion 5 through the bolster structure to the trucks 6.

The floor 9 of the car which is a preferred embodiment of this invention comprises a center sill 8 and a pair of concave floor panels 10 positioned one on each side of center sill 8. These are further described in U.S. Pat. No. 4,361,097. The rest of the car components and accessories such as rotary couplers, ladders and trucks 6 are conventional and well-known in the art of manufacturing railway cars.

Referring to FIGS. 2 and 3, the body bolster 7 of this invention is illustrated in more detail. Bolster 7 comprises a vertical plate 15 having an upper flange 16 bent parallel to and spaced from the inclined plate 5 of the end wall 3 of the car. A plurality of channel-like spacer members 17 are positioned at intervals across the full width of the bolster 7 as illustrated in FIG. 2 and provide a plurality of open vents 18. The vents 18 direct heat from the gas burners placed under the car during the thawing operation through the bolster 7 and close against the bottom surface of the inclined plate 5 at each of the end walls 3 of the car. The vents 18 also serve to reduce the air resistance while moving in a train caused by the conventional solid plate bolster used previously. While I have illustrated channel-like spacer members 17, other shapes could be used that provide sufficient structural strength for the body bolster and also provide openings for the passage of heated air.

While I have shown my invention by illustrating the preferred embodiment of it as a gondola car, the invention is equally applicable to bottom dump hopper cars also.

I claim:

1. A railway car for carrying bulk materials having a pair of sidewalls and a pair of end walls, each of said end walls having a vertical upper portion and a sloping lower portion, supported on spaced trucks by a pair of body bolsters, each of said bolsters having a solid lower vertical plate portion and an upper flange portion spaced from but adjacent and parallel to said sloping lower portion of said end wall, said upper flange portion having a plurality of channel-like spacer members secured between said upper flange portion and the exterior surface of said sloping lower portion of said end wall to allow the free flow of air against the exterior surface of said sloping lower portion of said end wall while said car is moving in a train and also during lading thawing operations.

2. The railway car of claim 1 in which the channel-like spacer members are substantially U-shaped metal channels positioned at regular intervals across the full width of said bolster.

3. A body bolster for supporting the body of a railroad freight car on a wheeled truck comprising a solid lower vertical plate portion and an upper flange portion spaced from but adjacent and parallel to the bottom surface of said railroad freight car and having a plurality of channel-like spacer members secured between said upper flange portion and said bottom surface of said railroad freight car to allow the free flow air against said bottom surface of said railroad freight car while said car is moving in a train and also during lading thawing operations.

4. The body bolster of claim 3 in which the channel-like spacer members are substantially U-shaped channels positioned at regular intervals across the full width of said bolster.

* * * * *